US008393757B2

(12) United States Patent
Uemoto et al.

(10) Patent No.: US 8,393,757 B2
(45) Date of Patent: Mar. 12, 2013

(54) LIGHT-BULB TYPE LED LAMP AND ILLUMINATION APPARATUS

(75) Inventors: Takaari Uemoto, Osaka (JP); Shinya Kawagoe, Osaka (JP); Naotaka Hashimoto, Osaka (JP); Toshiyasu Kojima, Osaka (JP); Taku Ikeda, Osaka (JP); Yasuyuki Ueda, Osaka (JP); Hideo Nagai, Osaka (JP); Hiroshi Nohara, Hyogo (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 13/387,345

(22) PCT Filed: Mar. 3, 2011

(86) PCT No.: PCT/JP2011/001250

§ 371 (c)(1),
(2), (4) Date: Jan. 26, 2012

(87) PCT Pub. No.: WO2011/108272

PCT Pub. Date: Sep. 9, 2011

(65) Prior Publication Data

US 2012/0120661 A1 May 17, 2012

(30) Foreign Application Priority Data

Mar. 4, 2010 (JP) ..... 2010-047984

(51) Int. Cl.
*F21S 4/00* (2006.01)

(52) U.S. Cl. ..... 362/249.03; 362/227; 362/249.01; 362/249.02; 362/249.1; 362/249.11; 362/373; 165/185

(58) Field of Classification Search ..... 362/249.03, 362/373, 227, 249.01, 249.02, 249.1, 249.11, 362/363, 800; 165/80.3, 185
See application file for complete search history.

(56) References Cited

U.S. PATENT DOCUMENTS 5,561,346 A * 10/1996 Byrne ..... 313/512
5,580,163 A * 12/1996 Johnson, II ..... 362/285
5,806,965 A * 9/1998 Deese ..... 362/249.04
6,341,877 B1 * 1/2002 Chong ..... 362/291
6,659,632 B2 * 12/2003 Chen ..... 362/545
7,285,903 B2 * 10/2007 Cull et al. ..... 313/500

(Continued)

FOREIGN PATENT DOCUMENTS

CN 201180919 1/2009
CN 201377739 1/2010

(Continued)

OTHER PUBLICATIONS

Chinese Application No. 201180003525.5 Office Action dated Oct. 31, 2012, 6 pages.

(Continued)

*Primary Examiner* — Mary McManmon

(57) ABSTRACT

Provided is a light-bulb type LED lamp 10 including a plurality of LEDs 67-78, a base 12, a lighting circuit unit that converts commercial power provided through the base 12 into power for lighting the LEDs 67-78, and a heat radiation member 16 that includes a bowl-shaped portion 42. Two stages 46 and 48, extending inwards from an inner circumferential surface 44 of the bowl-shaped portion 42, are provided in a direction of a central axis X of the bowl-shaped portion 42. The LEDs 67-78 are mounted on the stages 46 and 48 in a circumferential direction around the central axis X.

10 Claims, 9 Drawing Sheets

U.S. PATENT DOCUMENTS

| | | | | |
|---|---|---|---|---|
| 7,327,254 | B2 * | 2/2008 | Chen | 340/545.2 |
| 7,367,692 | B2 * | 5/2008 | Maxik | 362/307 |
| 7,482,632 | B2 * | 1/2009 | Lu et al. | 257/88 |
| 7,556,398 | B2 * | 7/2009 | Van Der Poel | 362/227 |
| 7,597,455 | B2 * | 10/2009 | Smith et al. | 362/249.01 |
| 7,604,380 | B2 * | 10/2009 | Burton et al. | 362/294 |
| 7,794,124 | B2 * | 9/2010 | Hulsey et al. | 362/477 |
| 7,936,119 | B2 * | 5/2011 | Cheng | 313/498 |
| 2002/0136010 | A1 * | 9/2002 | Luk | 362/250 |
| 2003/0090910 | A1 | 5/2003 | Chen | |
| 2003/0117803 | A1 * | 6/2003 | Chen | 362/276 |
| 2003/0193802 | A1 * | 10/2003 | Luk | 362/249 |
| 2004/0022057 | A1 * | 2/2004 | Lee | 362/238 |
| 2005/0099810 | A1 * | 5/2005 | Tasson et al. | 362/250 |
| 2005/0174769 | A1 * | 8/2005 | Yong et al. | 362/235 |
| 2005/0213324 | A1 * | 9/2005 | Chen | 362/249 |
| 2007/0159827 | A1 * | 7/2007 | Huang | 362/294 |
| 2007/0247840 | A1 * | 10/2007 | Ham, II | 362/227 |
| 2009/0027889 | A1 * | 1/2009 | Kang et al. | 362/294 |
| 2009/0140285 | A1 | 6/2009 | Lin et al. | |
| 2009/0302730 | A1 * | 12/2009 | Carroll et al. | 313/46 |
| 2009/0315442 | A1 * | 12/2009 | Rooymans | 313/46 |
| 2010/0103669 | A1 * | 4/2010 | Yang et al. | 362/234 |
| 2010/0156262 | A1 * | 6/2010 | Reingruber | 313/46 |
| 2010/0320892 | A1 * | 12/2010 | Yu | 313/46 |
| 2011/0026253 | A1 * | 2/2011 | Gill | 362/249.02 |
| 2011/0051420 | A1 * | 3/2011 | Gill | 362/249.03 |
| 2011/0075412 | A1 * | 3/2011 | Wu et al. | 362/235 |
| 2011/0228550 | A1 * | 9/2011 | Robinson | 362/555 |
| 2011/0255282 | A1 * | 10/2011 | Dassanayake et al. | 362/235 |
| 2011/0267812 | A1 * | 11/2011 | Van De Ven et al. | 362/235 |
| 2011/0310624 | A1 * | 12/2011 | Preuschl et al. | 362/373 |

FOREIGN PATENT DOCUMENTS

| | | |
|---|---|---|
| EP | 1 880 692 | 1/2008 |
| JP | 62-018775 | 1/1987 |
| JP | 2005-286267 | 10/2005 |
| JP | 2007-35366 | 2/2007 |
| JP | 2009-32466 | 2/2009 |
| JP | 2009-32590 | 2/2009 |
| JP | 2009-135440 | 6/2009 |
| JP | 2009-303280 | 12/2009 |
| TW | 533750 | 5/2003 |

OTHER PUBLICATIONS

European Application No. 11750385.4 Search Report dated Jan. 15, 2013, 6 pages.

* cited by examiner

LIGHT-BULB TYPE LED LAMP AND ILLUMINATION APPARATUS

TECHNICAL FIELD

The present invention relates to a light-bulb type LED lamp and an illumination apparatus, such as a light-bulb type LED lamp that is a suitable light source as a replacement for a reflector halogen light bulb, and an illumination apparatus provided with the light-bulb type LED lamp.

BACKGROUND ART

A reflector halogen light bulb combines a halogen light bulb with a bowl-shaped reflector having a concave reflecting surface. Such a reflector halogen light bulb is, for example, mounted in a downlight fixture and used as a spotlight in stores, galleries, or the like.

In order to decrease the frequency of replacement, which depends on the light bulb's life expectancy, while also promoting energy efficiency, light-bulb type light emitting diode (LED) lamps that use LEDs as a light source are being developed. These light-bulb type LED lamps have a longer life expectancy and consume less energy than halogen lamps. To serve as an alternative light source to reflector halogen light bulbs, it is necessary for light-bulb type LED lamps to be mountable in existing light fixtures and to closely resemble reflector halogen light bulbs in shape.

While some LEDs offer an amazing level of brightness, one LED still pales in comparison to the brightness offered by a halogen light bulb. It is thus necessary to use a plurality of LEDs. Patent Literature 1 discloses a light-bulb type LED lamp in which a disc-shaped substrate is provided at a position corresponding to the opening of the reflector in a reflector halogen light bulb. A plurality of LEDs are provided on the substrate.

[Citation List]

Patent Literature

Patent Literature 1: Japanese Patent Application Publication No. 2005-286267

SUMMARY OF INVENTION

Technical Problem

In the above conventional light-bulb type LED lamp, however, a problem occurs in that the closer an LED is located to the center of the substrate, the more heat the LED receives from surrounding LEDs. Therefore, LEDs at or near the center of the substrate become hotter than LEDs at the edge of the substrate. As a result, the luminous efficiency of LEDs decrease as the LEDs are positioned nearer the center of the substrate. One way to overcome the unevenness in luminous efficiency would be to mount a ring of LEDs along the edge of the substrate (around the circumference). Doing so would reduce the total number of LEDs, however, thus reducing the amount of light.

The present invention has been conceived in light of the above problem, and it is an object thereof to provide a light-bulb type LED lamp that suppresses fluctuation in luminous efficiency between LEDs without, insofar as possible, reducing the number of LEDs. It is also an object of the present invention to provide an illumination apparatus that includes such a light-bulb type LED lamp.

Solution to Problem

In order to solve the above problems, a light-bulb type LED lamp according to the present invention comprises a plurality of LEDs; a base; a lighting circuit configured to convert commercial power provided through the base into power for lighting the LEDs; and a heat radiation member having a bowl-shaped portion, at least two stages, each extending inwards from an inner circumferential surface of the bowl-shaped portion, being tiered in a direction of a central axis of the bowl-shaped portion, and the LEDs being mounted on the stages in a circumferential direction about the central axis.

Advantageous Effects of Invention

With the above structure for the light-bulb type LED lamp, LEDs are provided along the circumferential direction around the central axis of the bowl-shaped portion. Therefore, any one LED on any one of the stages is not surrounded by other LEDs. Furthermore, a section of the bowl-shaped portion is located between any one LED and the LEDs provided on an adjacent stage (adjacent to the stage on which the one LED is provided). Therefore, as compared to a conventional structure in which LEDs are provided in the same plane, the heat dissipation route between the LEDs is correspondingly longer, thus reducing the effect of heat from one LED on another. Moreover, since the section of the bowl-shaped portion is exposed to air, a large portion of heat is thought to dissipate along this section. This is another reason why the effect of heat from one LED on another is reduced. Variation in temperature between LEDs during lighting is thus reduced as compared to a conventional structure. Accordingly, variation in luminous efficiency between LEDs is reduced in so far as possible.

Of further note is how LEDs are provided in the circumferential direction on at least two stages, i.e. LEDs are provided in at least two tiered rings. It is therefore unnecessary to reduce the number of LEDs, unlike in the above conventional LED lamp, in which only one ring of LEDs is provided in order to reduce unevenness in luminous efficiency.

In order to solve the above problems, a light-bulb type LED lamp according to the present invention comprises a plurality of LEDs; a base; a lighting circuit configured to convert commercial power provided through the base into power for lighting the LEDs; and a heat radiation member having a bowl-shaped portion, individual stages, each extending inwards from an inner circumferential surface of the bowl-shaped portion, being provided for the LEDs in one-to-one correspondence, each LED being mounted on a mounting surface on the corresponding individual stage, the individual stages being arranged so that when viewing the LEDs from a central axis of the bowl-shaped portion, none of the LEDs is aligned with any other LED, and an angle of the mounting surface being changeable.

With the above structure for the light-bulb type LED lamp, LEDs are mounted on individual stages extending inwards from the inner circumferential surface of the bowl-shaped portion. Therefore, a section of the bowl-shaped portion is located between an individual stage on which an LED is mounted and an individual stage on which another LED is mounted. Therefore, as compared to a conventional structure in which LEDs are provided in the same plane, the heat dissipation route between the LEDs is correspondingly longer, thus reducing the effect of heat from one LED on another. Moreover, since the section of the bowl-shaped portion is exposed to air, a large portion of heat is thought to dissipate along this section. This is another reason why the effect of heat from one LED on another is reduced. Variation in temperature between LEDs during lighting is thus reduced as compared to a conventional structure. Accordingly, variation in luminous efficiency between LEDs is reduced in so far as possible.

Furthermore, the individual stages may be provided at any position along the inner circumferential surface as long as LEDs do not align when viewed in the radial direction from the bowl-shaped portion. It is therefore unnecessary to reduce the number of LEDs, unlike in the above conventional LED lamp, in which only one ring of LEDs is provided in order to reduce unevenness in luminous efficiency.

Of further note is how the angle of the LED mounting surface on each individual stage can be changed, thus allowing for the light-distribution characteristics of the lamp to be changed.

In order to achieve the above object, an illumination apparatus according to the present invention comprises a lighting fixture and the above light-bulb type LED lamp attached to the lighting fixture. Such an illumination apparatus achieves the same advantageous effects as the above light-bulb type LED lamp.

DESCRIPTION OF EMBODIMENTS

The following describes embodiments of a light-bulb type LED lamp according to the present invention with reference to the drawings. In this context, a light-bulb type LED lamp refers to a lamp that has a base such as the one described below and that can be mounted as is in a socket for halogen light bulbs or other incandescent light bulbs.

Embodiment 1

Figure 1:
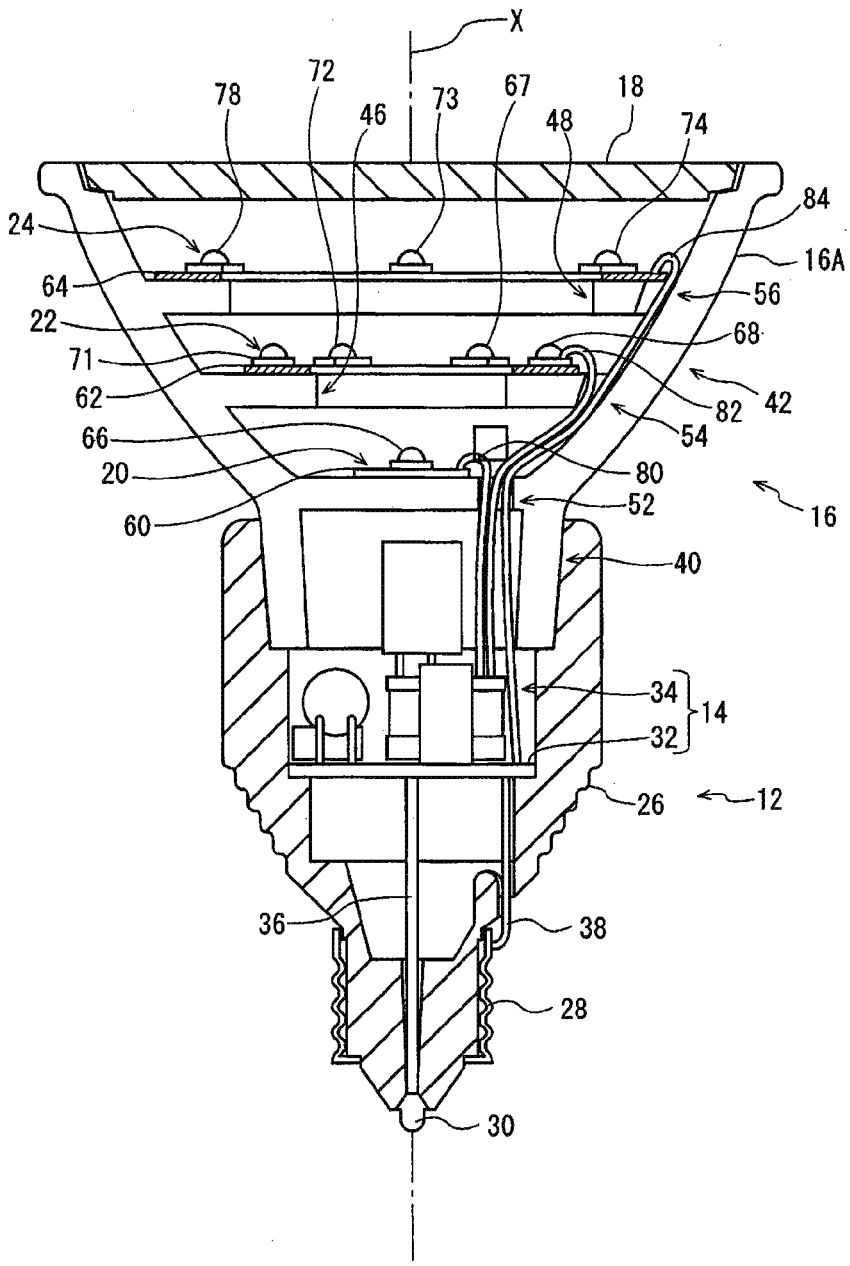
FIG. 1 is a front cross-section diagram of a light-bulb type LED lamp according to Embodiment 1.
Figure 2:
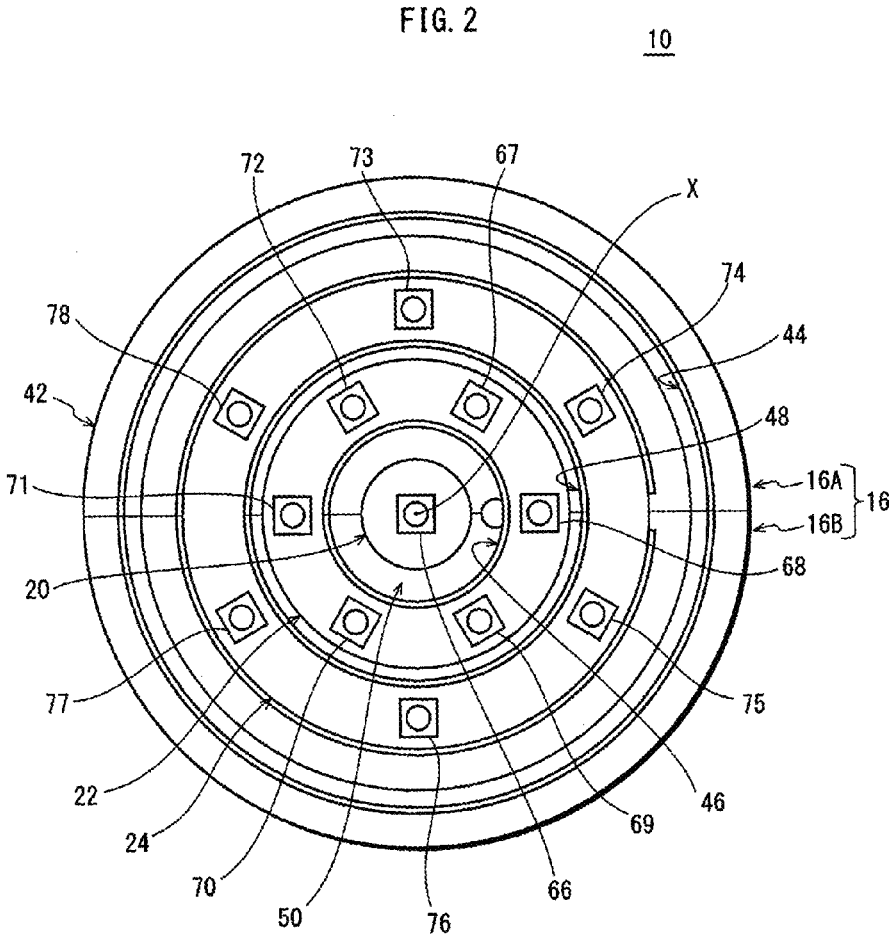
FIG. 2 is a plan view of the light-bulb type LED lamp.

FIG. 1 is a front cross-section diagram of a light-bulb type LED lamp 10 according to Embodiment 1 (hereinafter simply referred to as "LED lamp 10"). FIG. 2 is a plan view of the same. Note that FIG. 2 depicts the LED lamp 10 without a front glass 18. The front glass 18 is described below.

The LED lamp 10 is formed by a base 12, a lighting circuit unit 14, a heat radiation member 16, the front glass 18, LED modules 20, 22, 24, and the like.

The base 12 has a main body 26 formed by electric insulating material. One end of the main body 26 is generally cylindrical. A shell 28 is fit onto the generally cylindrical portion. One end of the cylindrical portion is in the approximate shape of a truncated cone. An eyelet 30 is fixed to the tip of the truncated cone. The base 12 conforms to a standard (such as the JIS standard) for attachment to a socket of a conventional lighting fixture for incandescent light bulbs.

The other end of the cylindrical portion of the main body 26 encloses a hollow space that expands with distance from the eyelet 30. The lighting circuit unit 14 is contained within the hollow space.

The lighting circuit unit 14 is formed by a circuit substrate 32 and a plurality of electronic components 34 mounted on the circuit substrate 32. The lighting circuit unit 14 and the eyelet 30 are electrically connected by a first lead wire 36. The lighting circuit unit 14 and the shell 28 are electrically connected by a second lead wire 38. The lighting circuit unit 14 converts commercial AC power, provided via the eyelet 30, the shell 28, the first lead wire 36, and the second lead wire 38, into power for lighting the LED modules 20, 22, and 24. The lighting circuit unit 14 then provides the converted power to the LED modules 20, 22, and 24.

The heat radiation member 16 is composed of a material with a good heat-conducting property, such as aluminum. The heat radiation member 16 includes the neck 40 and the bowl-shaped portion 42, which is attached to the neck 40. In FIGS. 1 and 2, a central axis X of the neck 40 and the bowl-shaped portion 42 is indicated by an alternating long and short dashed line.

The neck 40 is generally cylindrical and is fixed to the main body 26 of the base 12 by being inserted into an opening of the main body 26. The neck 40 may be fixed using adhesive, such as silicon resin or an adhesive having good thermal conductivity (for example, adhesive including thermal grease). Note that no adhesive is shown in the figures.

The heat radiation member 16 is a combination of two members (first member 16A and second member 16B) that are symmetrical about a plane.

Figure 3:
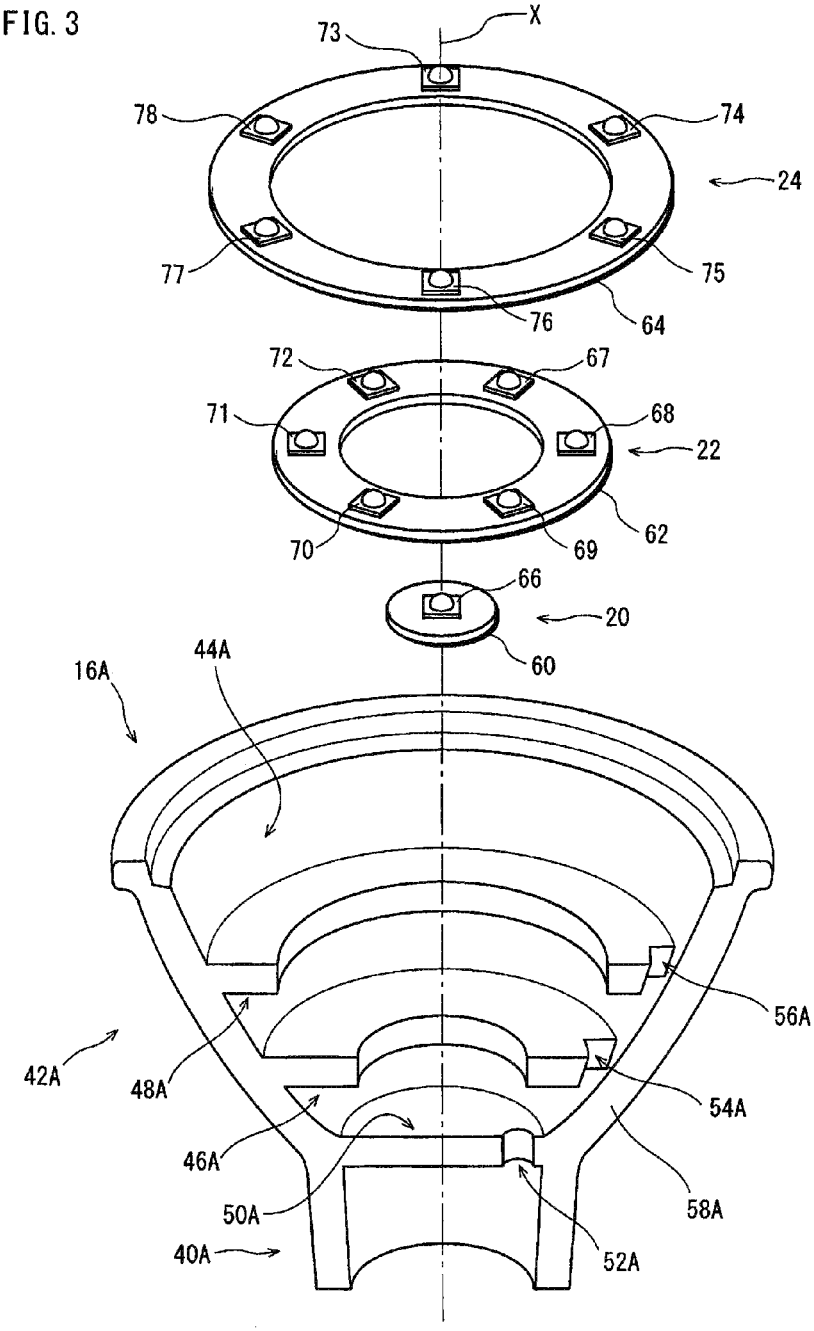
FIG. 3 is a perspective view of components of the light-bulb type LED lamp, specifically of a first member and three LED modules.

FIG. 3 shows a perspective view of the first member 16A and of LED modules 20, 22, and 24. FIG. 3 also shows a central axis X (of the heat radiation member 16) when the first member 16A and the second member 16B are joined together. The letter "A" is assigned to each component of the first member 16A. When illustrating the heat radiation member 16 after combination of the first member 16A and the second member 16B, corresponding components are shown only by number, without the letter "A".

The first member 16A includes a half cylinder 40A for forming the neck 40 (FIG. 1). The first member 16A also includes a half bowl-shaped portion 42A, attached to the half cylinder 40A, for forming the bowl-shaped portion 42 (FIG. 1).

A plurality of stages (in this embodiment, two stages 46A and 48A) protrude from an inner circumferential surface 44A of the half bowl-shaped portion 42A towards the center, i.e. towards the central axis X. The stage that is closer to a bottom 50A of the half bowl-shaped portion 42A is referred to as the first stage 46A, whereas the stage that is further from the bottom 50A is referred to as the second stage 48A.

Cutout sections 52A, 54A, and 56A are respectively provided at the bottom 50A of the first member 16A, at the first stage 46A, and at the second stage 48A. The cutout sections 52A, 54A, and 56A form through-holes for internal wires 80, 82, 84, described below, that electrically connect the LED modules 20, 22, and 24 with the lighting circuit unit 14.

The first member 16A also has a matching surface 58A that matches the second member 16B.

Combining the respective matching surfaces of the first member 16A and the second member 16B yields a first stage 46 and a second stage 48 that protrude from an inner circumferential surface 44 towards the center (i.e. towards the central axis X) in the shape of a disk, as shown in FIG. 2. The resulting shape approximates the shape of the reflector in a reflector halogen light bulb that has a base with the same standard size as the base 12. In other words, the reflector in a reflector halogen light bulb is typically bowl-shaped. Accordingly, by providing the bowl-shaped portion 42 with approximately the same size as a bowl-shaped reflector, the bowl-shaped portion 42 approximates such a bowl-shaped reflector in shape.

The LED module 20 is provided at a bottom 50 of the bowl-shaped portion 42. The LED module 22 is provided on the first stage 46. The LED module 24 is provided on the second stage 48.

As shown in FIG. 3, the LED module 20 includes a disk-shaped printed wiring board 60 and an LED 66 mounted thereon. The LED module 22 includes a disk-shaped printed wiring board 62 and LEDs 67, 68, 69, 70, 71, and 72 mounted thereon, and the LED module 24 includes a disk-shaped printed wiring board 64 and LEDs 73, 74, 75, 76, 77, and 78 mounted thereon. The LEDs 67-78 are mounted on the disk-shaped printed wiring boards 62 and 64 at even angular intervals (in the present embodiment, at 60° intervals) around the central axis thereof. All of the LEDs 66-78 are surface mounted device (SMD) white LEDs with a lens.

The LEDs 67-72 in the LED module 22 are electrically connected in series by a wiring pattern (not shown in the figures) on the printed wiring board 62. Similarly, the LEDs 73-78 in the LED module 24 are electrically connected in series by a wiring pattern (not shown in the figures) on the printed wiring board 64.

By varying the thickness of the bottom 50, the first stage 46, and the second stage 48 as necessary, individual heat dissipation can be improved. In other words, it is possible to reduce the effect of heat produced in the lighting circuit unit 14 by increasing the thickness of the bottom 50. As compared to the second stage 48, the number of LEDs per unit of area of the stage is higher in the first stage 46, making it difficult for heat to escape. In a case such as this, the first stage 46 may, for example, be made thicker than the second stage 48 in order to improve heat dissipation.

Returning to FIG. 2, the LED module 22 and the LED module 24 are centered on the central axis X and are provided respectively on the first stage 46 and the second stage 48 such that the LEDs 67-72 differ in position from the LEDs 73-78 by 30°. In other words, the LEDs 67-78 are provided in such a way that when the bowl-shaped portion 42 is viewed in a radial direction thereof from the central axis X, none of the LEDs provided on one stage is aligned with any of the LEDs provided on the other stage. This arrangement reduces, in so far as possible, variation in luminance along an illuminated surface.

Returning to FIG. 1, the printed wiring board 60 and the circuit substrate 32 are electrically connected by the internal wire 80 that traverses a through-hole 52. The printed wiring board 62 and the circuit substrate 32 are electrically connected by the internal wire 82 that traverses through-holes 52 and 54. Furthermore, the printed wiring board 64 and the circuit substrate 32 are electrically connected by the internal wire 84 that traverses through-holes 52, 54, and 56. The internal wires 80, 82, and 84 are connected by wiring patterns (not shown in the figures) on the circuit substrate 32 such that the LEDs 66-78 are electrically connected in series.

The LED lamp 10 as described above has the base 12 that is mountable in existing light fixtures for halogen light bulbs. The bowl-shaped heat radiation member 16 provided on the base 12 is similar to the reflector in a reflector halogen light bulb. The base 12 and the heat radiation member 16 provide the LED lamp 10 with its shape. Therefore, the LED lamp 10 can be mounted in existing light fixtures for reflector halogen light bulbs without causing problems with regards to space.

When the LED lamp 10 with the above structure is mounted in a light fixture and power is provided via the base 12, the 13 LEDs 67-78 each light up and emit heat.

Focusing for example on the LED 67 as shown in the plan view in FIG. 2, the LED 67 appears to be surrounded by the LEDs 73, 74, 68, and 72 and would thus seem to be influenced greatly by heat from these four LEDs 73, 74, 68, and 72.

The LED 67 is provided on a different stage, however, than the LEDs 73 and 74. These LEDs are thus not actually located in the same plane. The heat dissipation route from the LEDs 73 and 74 to the LED 67 runs from the second stage 48 to a section of the bowl-shaped portion 42 and then to the first stage 46. This route is substantially longer than when providing the LEDs 73 and 74 and the LED 67 in the same plane (for example, on the same substrate, as in a conventional configuration). Moreover, the outer circumferential surface of the section of the bowl-shaped portion 42 is exposed to air. A large portion of heat is thought to dissipate along this section, so that heat from the LEDs 73 and 74 has little effect on the LED 67.

The LEDs 68 and 72 exist in the same plane as the LED 67 (on the same printed wiring board 62) but are not crowded around the LED 67.

With the above-described structure, none of the 13 LEDs 66-78 in the LED lamp 10 is surrounded by other LEDs in the same plane. Therefore, as compared to when LEDs are provided on one substrate as in a conventional structure, each LED in the LED lamp 10 is less affected by heat from other LEDs. This structure therefore suppresses fluctuation in luminous efficiency between LEDs as compared to a conventional structure.

Note that each of the LED modules 20, 22, and 24 may be selectively lit. Selective lighting may be achieved by incorporating a selection circuit into the lighting circuit unit 14 using well-known technology and by providing a remote control also based on well-known technology.

With this structure, in addition to lighting all of the LED modules 20, 22, and 24, it is possible to light just one of the LED modules. If, for example, only the LED module 20 is lit, the LED lamp 10 may be used as a night-light, since the resulting brightness is equivalent to a miniature bulb.

It is also possible to light only two LED modules (i.e. combinations of the LED modules 20 and 22, the LED modules 20 and 24, or the LED modules 22 and 24 are possible). The brightness of the LED lamp may thus be changed gradually.

Embodiment 2

Figure 4:
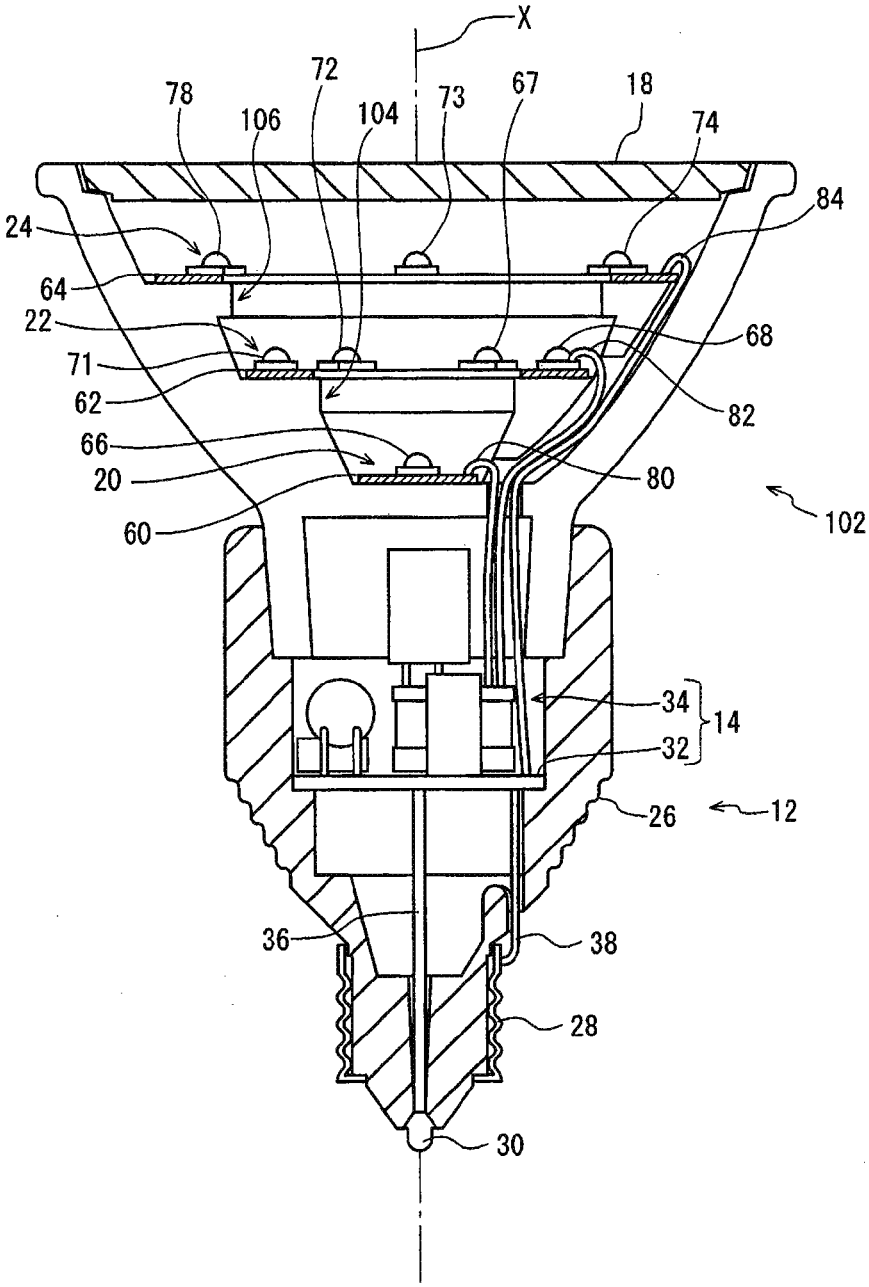
FIG. 4 is a front cross-section diagram of a light-bulb type LED lamp according to Embodiment 2.

FIG. 4 is a front cross-section diagram of a light-bulb type LED lamp 100 according to Embodiment 2 (hereinafter simply referred to as "LED lamp 100"). FIG. 4 is drawn similar to FIG. 1.

The LED lamp 100 according to Embodiment 2 has a structure similar to the LED lamp 10 (FIG. 1) according to Embodiment 1, except for the shape of the heat radiation member. Accordingly, constituent elements that are similar to the LED lamp 10 are labeled with the same reference signs, and an explanation thereof is omitted. The following focuses on the differences between the LED lamps 100 and 10.

In order to increase the volume of a heat radiation member 102 in Embodiment 2, a first stage 104 and a second stage 106 differ from the first stage 46 and the second stage 48 in Embodiment 1 in that the lower side of the first stage 104 and the second stage 106 are filled in with material for forming the heat radiation member 102 (in this embodiment, aluminum) with almost no open space provided. In other words, the thickness of the bowl-shaped portion is increased between the bottom and the first stage and between the first stage and the second stage. As a result, the heat capacity of the heat radiation member 102 increases, thus suppressing a rise in temperature of the LEDs 66-78 (only partially shown in FIG. 4).

Furthermore, due to this increase in thickness, the inner circumferential surface between the bottom and the first stage is closer to the LED 66, and the inner circumferential surface between the first stage and the second stage is closer to the LEDs 67-72 (only partially shown in FIG. 4) of the LED module 22. These inner circumferential surfaces act as reflecting surfaces for the corresponding LEDs, thus efficiently projecting light from the LEDs away from the lamp.

Embodiment 3

In Embodiments 1 and 2, the first stage 46 or 104 and the second stage 48 or 106 are formed as rings centering on the central axis X (i.e. formed integrally around the central axis X). On the other hand, in the light-bulb type LED lamp according to Embodiment 3 (hereinafter simply referred to as "LED lamp"), the stages are divided into a plurality of sections in the circumferential direction, and the angle of each section (i.e. LED mounting surface in each individual stage) is changeable.

The base 12, the lighting circuit unit 14, the front glass 18, and the LEDs 67-78 are the same in Embodiment 3 as in Embodiments 1 and 2. Therefore, these components are omitted from the drawings and from the description below, which focuses on the differences in Embodiment 3.

Figure 5A:
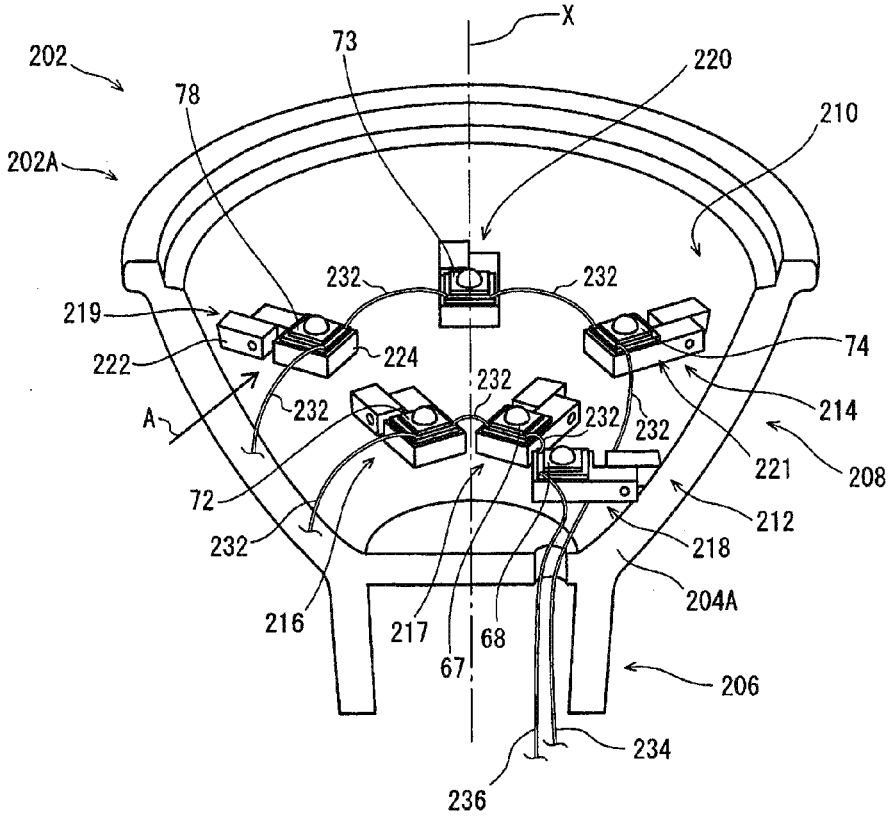
FIG. 5A is a perspective view of a first member in a light-bulb type LED lamp according to Embodiment 3, in which a first member and a second member form a heat radiation member having a neck and a bowl-shaped portion.

FIG. 5A is a perspective view of a first member 202A in the LED lamp according to Embodiment 3, in which a first member and a second member form a heat radiation member having a neck and a bowl-shaped portion. Note that the second member, which is not shown in the figures, is symmetrical with the first member 202A, with the central axis X as an axis of symmetry. As in Embodiment 1, the heat radiation member is formed by combining respective matching surfaces 204A of the first member and the second member. For the sake of convenience, the following describes the heat radiation member 202 assuming that the first member 202A and the second member (not shown in the figures) have been combined.

Like Embodiment 1, the heat radiation member 202 includes a neck 206 and a bowl-shaped portion 208 connected to the neck 206.

A first stage 212 and a second stage 214 protrude inwards (towards the central axis X) from an inner circumferential surface 210 of the bowl-shaped portion 208, thus forming two levels centered on the central axis X.

The first stage 212 and the second stage 214 are each formed by a plurality of stages (in this embodiment, six stages (three of which are not shown in FIG. 5A)) provided along the circumferential direction around the central axis X, i.e. individual stages 216-218 in the first stage 212 and individual stages 219-221 in the second stage 214. All of the individual stages 216-221 have a similar structure. The following describes the individual stage 219 in the second stage 214 as a representative example.

Figure 5B:
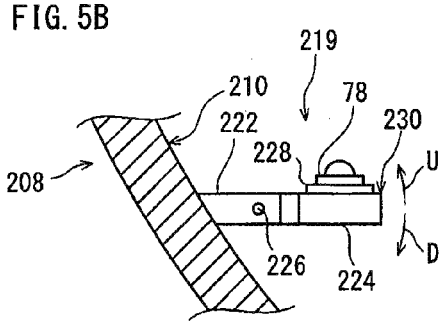
FIGS. 5B and 5C show side views of an individual stage.
Figure 5C:
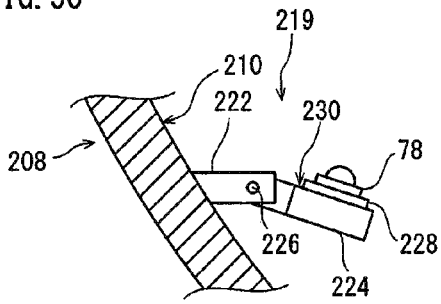

FIGS. 5B and 5C show the individual stage 219 when viewed in the direction of the arrow A in FIG. 5A.

The individual stage 219 includes a fixed section 222 and a moveable section 224 connected thereto. The fixed section 222 protrudes from the inner circumferential surface 210 of the bowl-shaped portion 208 towards the central axis X. Note that the structure in which the fixed section 222 protrudes from the bowl-shaped portion 208 may, for example, be cast by investment casting. Alternatively, an insertion hole may be provided in the fixed section 222 in the direction of thickness of the bowl-shaped portion 208, and an edge of a separately manufactured fixed section 222 may be inserted into the insertion hole.

The fixed section 222 and the moveable section 224 are connected by a straight pin 226 that is forcibly inserted into a through-hole provided in both the fixed section 222 and the moveable section 224. The pin 226 is perpendicular to the radial direction of the bowl-shaped portion 208. The moveable section 224 is pivotally supported so as to be rotatable around the axis of the pin 226 in the directions indicated by arrows U and D.

A rectangular printed substrate 228 is fixed to the LED mounting surface 230 on the moveable section 224. An LED 78 is mounted on the printed substrate 228. The state shown in FIG. 5B in which the LED mounting surface 230, and therefore the main surface of the printed substrate 228, are parallel with a direction perpendicular to the central axis X is referred to as a "standard state". In the standard state, light from the LED 78 is emitted exclusively in a direction parallel to the central axis X. When all of the individual stages 216-221 are in the standard state, the arrangement of LEDs in a plan view of the LED lamp is the same as in the view of Embodiment 1 in FIG. 2.

By adopting the individual stage 219 with the above structure, the angle at which the LED 78 emits light with respect to the central axis X can be changed by rotating the moveable section 224 away from the standard state, for example with one's finger. By rotating in the direction of the arrow D, light is focused towards the central axis X, whereas by rotating in the direction of the arrow U, light is spread to illuminate a wider surface.

Among the LEDs 67, 68, 72, 73, 74, and 78, as well as the other six LEDs not shown in FIG. 5A, LEDs that are mounted on adjacent individual stages are connected in series by internal wires 232. The LEDs in each stage that are connected in series are connected to the circuit substrate 32 via internal wires 234 and 236. The LEDs, which are connected in series within each stage, are further connected in series between stages by a wiring pattern in the circuit substrate 32.

Embodiment 4

Figure 6:
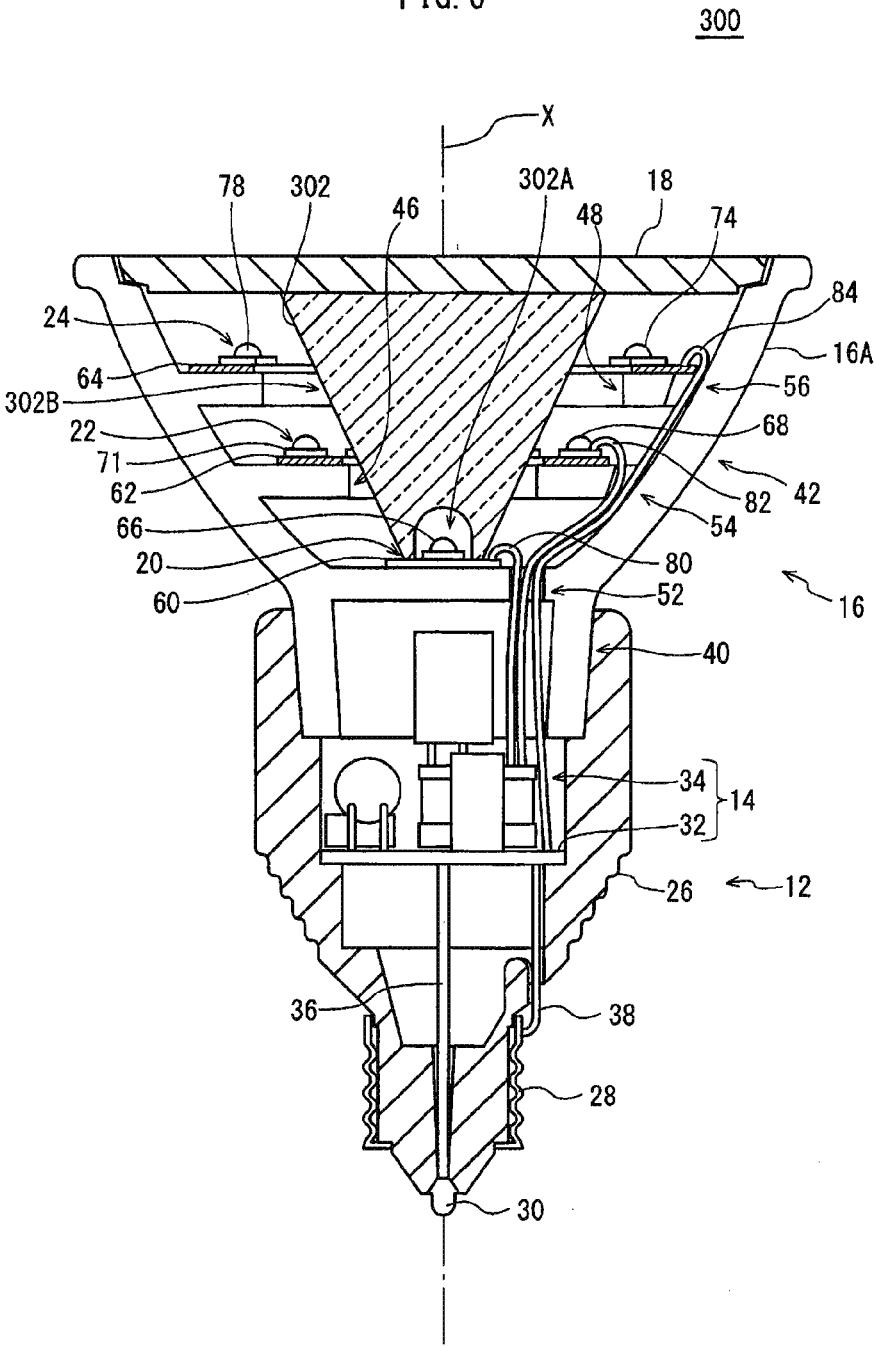
FIG. 6 is a front cross-section diagram of a light-bulb type LED lamp according to Embodiment 4.

FIG. 6 is a front cross-section diagram of a light-bulb type LED lamp 300 according to Embodiment 4 (hereinafter simply referred to as "LED lamp 300"). FIG. 6 is drawn similar to FIG. 1.

In addition to the LED lamp 10 (FIG. 1) in Embodiment 1, the LED lamp 300 includes a light-diffusion member 302, which is described below. Other than inclusion of the light-diffusion member 302, the LED lamp 300 has a similar structure to the LED lamp 10.

Accordingly, in FIG. 6, constituent elements that are the same as the LED lamp 10 (FIG. 1) are labeled with the same reference signs as in FIG. 1, and an explanation thereof is omitted. The following focuses on the light-diffusion member 302.

The light-diffusion member 302 has the overall shape of a truncated cone and is contained within the bowl-shaped heat radiation member 16 with the tip of the truncated cone facing the bottom of the heat radiation member 16. In this position, the central axis of the truncated cone overlaps the central axis X. A concavity 302A is provided at the tip of the light-diffusion member 302. An LED 66 is contained within the concavity 302A. The bottom surface of the light-diffusion member 302 is fixed to the front glass 18 by translucent adhesive, so that attaching the front glass 18 to the heat radiation member 16 results in assembly of the light-diffusion member 302 with the heat radiation member 16.

The light-diffusion member 302 is formed from translucent resin, such as acrylic resin, from glass, or from another translucent material.

By providing such a light-diffusion member 302, a portion of light that is emitted from the LEDs 67-78 is reflected by a side 302B of the light-diffusion member 302, whereas another portion of the light enters the light-diffusion member 302. This portion of light is repeatedly reflected within the light-diffusion member 302 and then emitted away from the lamp. As a result, the LED lamp 100 provides a wider output range (output angle) of light than the LED lamp 10.

Modifications

In the LED lamp 300 in Embodiment 4, the LED module 20 may be removed, and the light-diffusion member 302 may be made a perfect truncated cone that does not include the concavity 302A.

Furthermore, the light-diffusion member 302 may be incorporated into the LED lamps in Embodiments 2 and 3.

Embodiment 5

Figure 7:
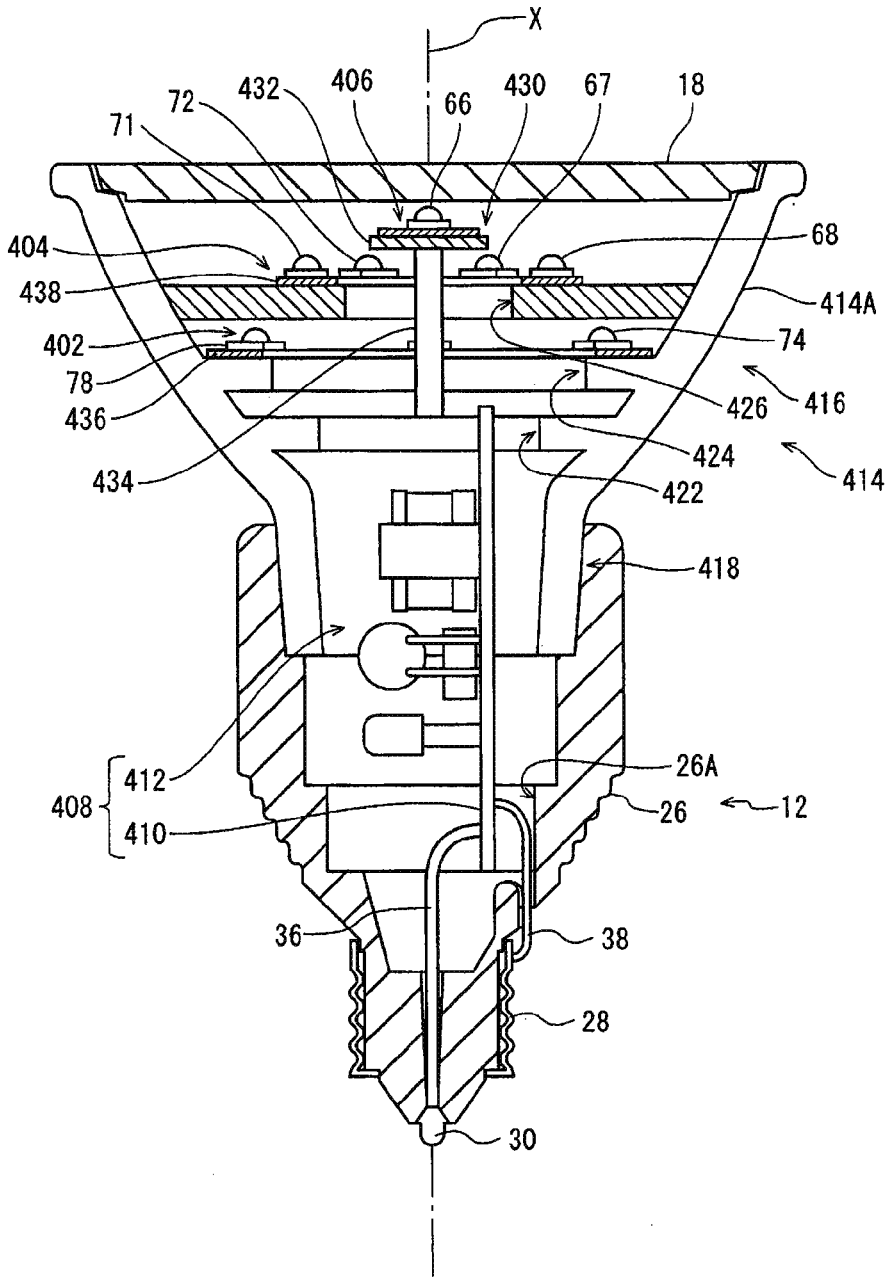
FIG. 7 is a front cross-section diagram of a light-bulb type LED lamp according to Embodiment 5.
Figure 8:
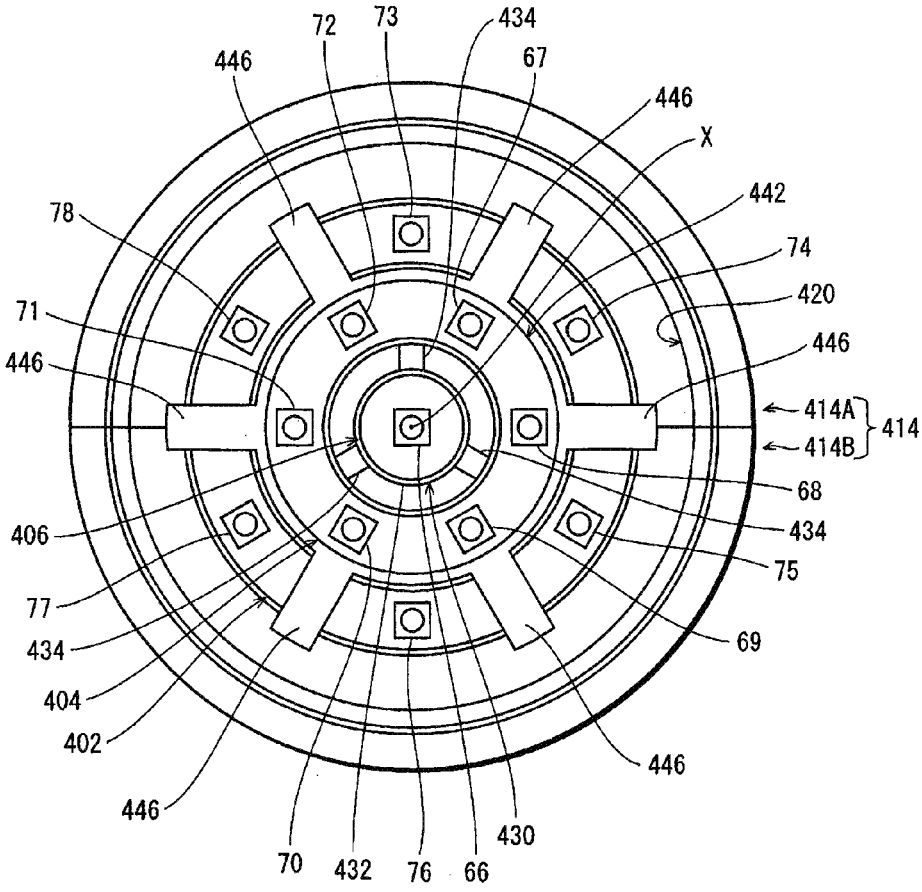
FIG. 8 is a plan view of a light-bulb type LED lamp according to Embodiment 5.

FIG. 7 is a front cross-section diagram of a light-bulb type LED lamp 400 according to Embodiment 5 (hereinafter simply referred to as "LED lamp 400"), and FIG. 8 is a plan view of the LED lamp 400. FIGS. 7 and 8 are drawn similar to FIGS. 1 and 2 respectively.

In the LED lamp 10 in Embodiment 1, the LED module 20 with one LED 66, the LED module 22 with six LEDs 67-72 provided in a ring, and the LED module 24 with six LEDs 73-78 provided in a larger ring are arranged in this order along the central axis X. In other words, the LED modules are arranged from smallest to largest, with the LED module 20 closest to the base 12. In the LED lamp 400 in Embodiment 5, on the other hand, the order of arrangement of the LED modules is reversed.

Specifically, in the LED lamp 400, an LED module 402 with six LEDs 73-78 provided in a ring, an LED module 404 with six LEDs 67-72 provided in a smaller ring, and an LED module 406 with one LED 66 are arranged in this order along the central axis X. In other words, the LED modules are arranged from largest to smallest, with the LED module 402 closest to the base 12.

Furthermore, in the LED lamp 10 in Embodiment 1, the lighting circuit unit 14 is provided in a position such that the circuit substrate 32 is perpendicular to the central axis X, i.e. crosswise. Conversely, in the LED lamp 400 in Embodiment 5, the lighting circuit unit 408 is provided in a position such that the circuit substrate 410 is parallel to the central axis X, i.e. lengthwise.

Other than the above-described differences in the order of arrangement of the LED modules and the direction in which the lighting circuit unit is provided, the LED lamp 400 has a similar structure to the LED lamp 10. Accordingly, constituent elements that are substantially the same as in the LED lamp 10 are labeled with the same reference signs in FIGS. 7 and 8, and an explanation thereof is omitted. The following focuses on the differences between the LED lamps 400 and 10.

The lighting circuit unit 408 is formed by a circuit substrate 410 and a plurality of electronic components 412 mounted on the circuit substrate 410. The edge of the circuit substrate 410 near the shell 28 is contained within the main body 26 of the base 12 by being inserted into a pair of opposing grooves (not shown in the figures) provided in parallel with the central axis X along an inner circumferential surface 26A of the main body 26. The other edge of the circuit substrate 410 protrudes from the base 12, reaching a bowl-shaped portion 416 of a heat radiation member 414.

As in Embodiment 1, the heat radiation member 414 is a combination of two members (first member 414A and second member 414B) that are symmetrical about a plane.

Figure 9:
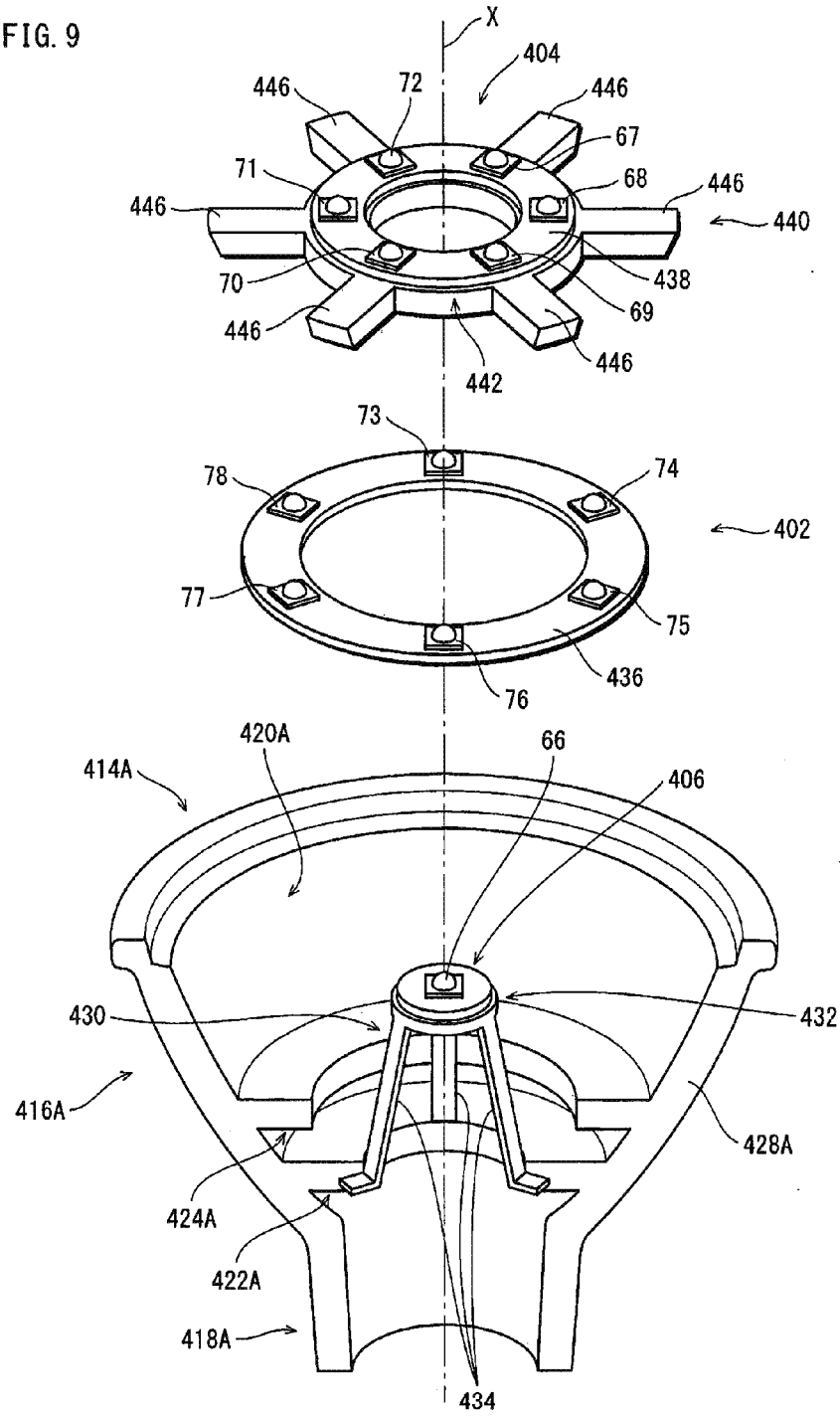
FIG. 9 is a perspective view of components of a light-bulb type LED lamp according to Embodiment 5, specifically of a first member and three LED modules.

FIG. 9 is a perspective view of the first member 414A and of three LED modules 402, 404, and 406. FIG. 9 is drawn similar to FIG. 3. In Embodiment 5 as well, as in Embodiment 1, the letter "A" is assigned to each component of the first member 414A. When illustrating the heat radiation member 414 after combination of the first member 414A and the second member 414B, corresponding components are shown only by number, without the letter "A".

The first member 414A includes a half cylinder 418A for forming the neck 418 (FIG. 7). The first member 414A also includes a half bowl-shaped portion 416A, attached to the half cylinder 418A, for forming the bowl-shaped portion 416 (FIG. 7). Note that unlike in Embodiment 1, the bowl-shaped portion 416 does not have a bottom (FIG. 7).

Two stages, i.e. stages 422A and 424A, protrude from an inner circumferential surface 420A of the half bowl-shaped portion 416A towards the center (towards the central axis X). The stage 422A is provided to fix legs 434 of an attachment member 430, described below, that is provided for the LED module 406. The stage 422A is hereinafter referred to as a leg fixing stage 422A. The stage 424A is provided for mounting of an LED module 402 and is hereinafter referred to as a first stage 424A. Note that a second stage 426 for mounting of an LED module 404 is described below.

The first member 414A has a matching surface 428A that matches the second member 414B.

Combining the respective matching surfaces of the first member 414A and the second member 414B yields the leg fixing stage 422 and the first stage 424 that protrude from an inner circumferential surface 420 (FIG. 8) towards the center (i.e. towards the central axis X) in the shape of a disk. As in Embodiment 1, the resulting shape approximates the shape of the reflector in a reflector halogen light bulb.

The LED module 406 is fixed to the leg fixing stage 422 via the attachment member 430. The LED module 406 has a similar structure to the LED module 20 (FIG. 3) in Embodiment 1. The attachment member 430 has a disk-shaped seat 432 and three legs 434 each extending in a different direction from the outer circumference of the seat 432. The attachment member 430 is formed from a metal with excellent thermal conductivity, such as aluminum. The LED module 406 is fixed to the seat 432 by adhesive with excellent thermal conductivity. The tip of each of the three legs 434 is bent, and the bent portion is connected to the leg fixing stage 422 by solder or the like (not shown in the figures).

The LED module 402, the largest among the three LED modules 402, 404, and 406, is mounted on the first stage 424. The LED module 402 has a similar structure to the LED module 24 (FIG. 3), except that a printed wiring board 436 therein is slightly smaller.

The LED module 404 has a similar structure to the LED module 22 (FIG. 3), except that a printed wiring board 438 therein is slightly smaller. The LED module 404 is attached to the bowl-shaped portion 416 via a fixing member 440.

The fixing member 440 is formed by a disk 442 and six arms 446. The six arms 446 extend radially from the outer circumference of the disk and are spaced at equal angular intervals. The apical surface of each arm 446 is cut to match the inclination (curvature) of the inner circumferential surface 420 of the bowl-shaped portion 416.

The fixing member 440 is fit into the bowl-shaped portion 416 with the central axis of the disk 442 aligned with the central axis X. Note that the fixing member 440 is fit so that none of the arms 446 in plan view, as shown in FIG. 8, overlaps with any of the LEDs 73-78 constituting the LED module 402. It is preferable to fit the fixing member 440 so that each of the arms 446 is positioned halfway between adjacent LEDs.

Once the fixing member 440 has been fit into the bowl-shaped portion 416, approximately the entire apical surface of each arm 446 is in contact with the inner circumferential surface of the bowl-shaped portion 416. In this state, the tip of each arm 446 is connected to the bowl-shaped portion 416 by solder or the like, not shown in the figures, to integrate the fixing member 440 with the bowl-shaped portion 416. The fixing member 440 thus forms part of the heat radiation member 414, specifically the second stage 426 that extends from the inner circumferential surface 420 of the bowl-shaped portion 416 towards the center (towards the central axis X).

The LED module 404 is provided on the ring 442 of the second stage 426.

Note that each of the LED modules 402, 404, and 406 are electrically connected to the lighting circuit unit 408 by wires, not shown in the figures, that are inserted through hollow portions of the heat radiation member 414.

The above-described structure achieves similar advantageous effects as Embodiment 1. Namely, none of the 13 LEDs 66-78 in the LED lamp 400 is surrounded by other LEDs in the same plane. Therefore, as compared to when LEDs are provided on one substrate as in a conventional structure, each LED in the LED lamp 400 is less affected by heat from other LEDs. This structure therefore suppresses fluctuation in luminous efficiency between LEDs as compared to a conventional structure.

While embodiments of a light-bulb type LED lamp have been described, an illumination apparatus may be formed by providing a light fixture having mounting therein a light-bulb type LED lamp according to any of the above embodiments. In this case, as described above, the heat radiation member attached to the base in the light-bulb type LED lamp has a similar form (shape) as the reflector in a reflector halogen light bulb, specifically a bowl shape. Therefore, the light-bulb type LED lamp can easily be combined with a lighting fixture for a reflector halogen light bulb (such as a downlight lighting fixture) to provide an illumination apparatus.

The light-bulb type LED lamp is in no way limited to the above embodiments. For example, the following embodiments are also possible.

(1) In Embodiments 1, 2, 4, and 5, two stages are provided vertically along the central axis X. However, the number of stages is not limited to two and may instead be three or more. Since the main purpose is to provide a light source as a replacement for a reflector halogen light bulb, the size of the reflector varies according to the size of the halogen light bulb to be replaced. Since the heat radiation member is formed to match the size of the reflector, the size of the heat radiation member also changes. The number of stages thus changes as well.

(2) In Embodiments 1 and 2, the LED 66 is provided at the bottom of the bowl-shaped portion of the heat radiation member, but this LED need not be provided. When this LED is not provided, the bottom of the bowl-shaped portion may be raised by a corresponding amount in a direction opposite the lighting circuit unit 14, thereby amplifying the space for enclosing the lighting circuit unit 14.

(3) In Embodiment 3, the LED mounting surfaces of the individual stages 216, 217, and 218 are arranged to be in the same plane in the standard state, as are the LED mounting surfaces of the individual stages 219, 220, and 221. The individual stages are not limited in this way, however, and may be arranged as follows.

The individual stages may be arranged so that the LED mounting surfaces of the individual stages are arranged along an imaginary helix that spirals around the central axis X. The helix in this case is preferably shaped as a cone in which the distance from the central axis X grows longer as the cone approaches the opening of the bowl-shaped portion. It is also obviously preferable that when viewed from the central axis X, none of the LEDs be aligned with any of the other LEDs.

Any arrangement other than the above arrangements may also be adopted. In sum, any arrangement is possible as long as the LEDs are not aligned when viewed from the central axis X.

(4) In Embodiment 3, one LED is mounted on each stage, but the number of LEDs mounted on each stage is not limited to one. Two or three LEDs (i.e. any predetermined number of LEDs) among a plurality of LEDs in the LED lamp may be provided on each individual stage.

Furthermore, the number of LEDs may differ between stages.

(5) With respect to the stages, the structure of Embodiment 3 may be combined with the structure of any of Embodiments 1, 2, 4, and 5. For example, the first stage may be formed as in Embodiment 1 or 2, with the second stage being formed as a group of individual stages as in Embodiment 3, or vice-versa.

In other words, among a plurality of stages, at least one stage may be formed as a group of individual stages as in Embodiment 3.

INDUSTRIAL APPLICABILITY

The light-bulb type LED lamp according to the present invention is appropriate for use as a replacement, for example, for a reflector halogen light bulb.

REFERENCE SIGNS LIST

10, 100, 300, 400 light-bulb type LED lamp
12 base
14, 408 lighting circuit unit
16, 102, 202, 414 heat radiation member
42, 208 bowl-shaped portion
46, 104, 212, 424 first stage
48, 106, 214, 426 second stage
66-78 LED
216-221 individual stage
230 mounting surface

The invention claimed is:

1. A light-bulb type LED lamp comprising: a plurality of LEDs; a base; a lighting circuit configured to convert commercial power provided through the base into power for lighting the LEDs; and a heat radiation member having a bowl-shaped portion, the bowl-shaped portion having a light transmitting opening through which light emitted by the LEDs is transmitted; at least two independent stages, each stage extending inwards inward from a different location along an inner circumferential surface of the bowl-shaped portion, and being tiered in a direction of a central axis of the bowl-shaped portion, and the LEDs being mounted on the stages in a circumferential direction about the central axis, at least one stage being divided into a plurality of sections in the circumferential direction, and the at least one stage being separately fastened to the inner surface of the bowl-shaped portion with a fastening member, the at least one stage being pivotable about the fastening member such that an angle of an LED mounting surface on each section is changeable with respect to the central axis.

2. The light-bulb type LED lamp of claim 1, wherein the LEDs are arranged so that when viewing the LEDs from the central axis in a radial direction of the bowl-shaped portion, none of the LEDs mounted on any one of the stages is aligned with any of the LEDs mounted on an adjacent stage.

3. The light-bulb type LED lamp of claim 1, wherein a shape of the bowl-shaped portion in the heat radiation member approximates a shape of a reflector in a reflector halogen light bulb having a base with a same size as the base of the light-bulb type LED lamp.

4. An illumination apparatus comprising:

a lighting fixture; and the light-bulb type LED lamp of claim 1 attached to the lighting fixture.

5. The light bulb type of LED lamp of claim 1 wherein at least one stage is integrally formed to extend inward from the inner surface of the bowl-shaped portion.

6. A light-bulb type LED lamp comprising: a plurality of LEDs; a base; a lighting circuit configured to convert commercial power provided through the base into power for lighting the LEDs; and a heat radiation member having a bowl-shaped portion, the bowl-shaped portion having a light transmitting opening through which light emitted by the LEDs is transmitted; at least a plurality of individual stages, each extending inwards inward from a different location along an inner circumferential surface of the bowl-shaped portion, being provided for the LEDs in one-to-one correspondence, each LED being mounted on a mounting surface on the corresponding individual stage, the individual stages being arranged so that when viewing the LEDs from a central axis of the bowl-shaped portion, none of the LEDs are aligned with any other LED, and the at least one stage is separately fastened to the inner surface of the bowl-shaped portion with a fastening member, the at least one stage being pivotable about the fastening member such that an angle of the mounting surface is changeable with respect to the central axis.

7. The light-bulb type LED lamp of claim 6, wherein a shape of the bowl-shaped portion in the heat radiation member approximates a shape of a reflector in a reflector halogen light bulb having a base with a same size as the base of the light-bulb LED lamp.

8. An illumination apparatus comprising:

a lighting fixture; and the light-bulb type LED lamp of claim 6 attached to the lighting fixture.

9. A light-bulb type LED lamp comprising: a plurality of LEDs; a base; a lighting circuit configured to convert commercial power provided through the base into power for lighting the LEDs; and a heat radiation member, having an outer bowl-shaped portion with a light transmitting opening through which light emitted by the LEDs is transmitted, for radiating heat with at least two independent interior support stages, each stage extending inward from a different location along an inner circumferential surface of the bowl-shaped portion, and the stages being tiered from each other along a direction of a central axis of the bowl-shaped portion to provide separate thermal heat conduction paths for each of the individual LEDs to the bowl-shaped portion, and the LEDs being mounted on the respective stages about the central axis, and at least one stage being separately fastened to the inner surface of the bowl-shaped portion with a fastening member, the at least one stage being pivotable about the fastening member such that an angle of an LED mounting surface is changeable with respect to the central axis.

10. The light-bulb type LED lamp of claim 9, wherein the LEDs are arranged so that when viewing the LEDs from the central axis in a radial direction of the bowl-shaped portion, none of the LEDs mounted on any one of the stages is aligned with any of the LEDs mounted on an adjacent stage.

* * * * *